US006981347B1

(12) United States Patent
Walburger

(10) Patent No.: US 6,981,347 B1
(45) Date of Patent: Jan. 3, 2006

(54) MODULAR EMERGENCY SHELTER SYSTEM

(76) Inventor: Randy Walburger, 1930 Stewart St., X12, Santa Monica, CA (US) 90404

( * ) Notice: Subject to any disclaimer, the term of this patent is extended or adjusted under 35 U.S.C. 154(b) by 394 days.

(21) Appl. No.: 10/083,178

(22) Filed: Feb. 25, 2002

(51) Int. Cl.

| | |
|---|---|
| ***E04H 1/00*** | (2006.01) |
| ***E04H 14/00*** | (2006.01) |
| ***E04H 3/00*** | (2006.01) |
| ***E04H 5/00*** | (2006.01) |
| ***E04H 6/00*** | (2006.01) |

(52) U.S. Cl. ..... 52/79.1; 52/36.2; 52/34; 52/592.6

(58) Field of Classification Search ..... 52/36.1, 52/36.2, 79.1, 79.7, 34, 236.3, 592.6, 79.8
See application file for complete search history.

(56) References Cited

U.S. PATENT DOCUMENTS

| | | | | |
|---|---|---|---|---|
| 1,857,189 A | | 5/1932 | Gillespie | |
| 2,607,047 A | | 8/1952 | Posey | |
| 3,553,911 A | | 1/1971 | Morrow et al. | |
| 3,778,528 A | * | 12/1973 | Heifetz et al. | 174/48 |
| 3,792,558 A | * | 2/1974 | Berce et al. | 52/79.7 |
| 3,923,134 A | | 12/1975 | Rezazadeh | |
| 4,594,817 A | | 6/1986 | McLaren et al. | |
| 4,653,238 A | | 3/1987 | Berman | |
| 5,081,805 A | * | 1/1992 | Jazzar | 52/79.2 |
| 5,111,626 A | | 5/1992 | Fortune | |
| 5,203,707 A | * | 4/1993 | Musto et al. | 434/226 |
| 5,224,305 A | | 7/1993 | Kassai | |
| 5,265,384 A | | 11/1993 | Menke et al. | |
| 5,487,240 A | | 1/1996 | Miller | |
| 5,537,787 A | * | 7/1996 | Abraham | 52/79.1 |
| 5,638,646 A | | 6/1997 | Shane | |
| 5,784,836 A | | 7/1998 | Ehrick | |
| 6,155,747 A | * | 12/2000 | Payne et al. | 405/129.55 |
| 6,179,522 B1 | * | 1/2001 | Sanford et al. | 405/129.55 |
| 6,256,936 B1 | * | 7/2001 | Swensson et al. | 52/35 |

* cited by examiner

*Primary Examiner*—Carl D. Friedman
*Assistant Examiner*—Chi Q. Nguyen

(57) ABSTRACT

A modular emergency shelter system includes a sleeping and storage module having a rectangular box-like structure with curved interior sidewalls defining a sleeping area, and exterior sidewalls extending to an opposing end defining a separate storage area. The box-like structure is preferably fabricated of molded plastic filled with fire resistant and sound dampening foam, and is watertight to keep out the rain and facilitate hosing out after use. Preferably the module includes electronic locking doors operable from inside or outside the module. The module is specially configured for securing together a number of similar structures including additional shelter modules stacked one atop another, or vertically-oriented modular utility units such as toilets, showers and a dressing rooms. Use of the emergency shelter modules is envisioned as including taking reservations electronically over the telephone or Internet, and providing for a particular sleeping module and storage module to unlock the doors later that day.

7 Claims, 3 Drawing Sheets

MODULAR EMERGENCY SHELTER SYSTEM

BACKGROUND OF THE INVENTION

1. Field of the Invention

This invention relates to temporary shelters for the homeless or other emergency uses, and more particularly to a grouping of specially designed modules to be utilized by individuals for sleeping compartments and storage of belongings.

2. Description of the Related Art

Problems of homelessness, especially in cities and especially in the South are well known. In greater Los Angeles a large homeless population is concentrated near downtown which is generally vacated by working people at night, and in surrounding cities that tolerate the homeless such as Santa Monica. The needs of the homeless are acute at night when they need sleep, the weather is cold and safety is more of an issue. Additionally, once an individual has been homeless for any period of time it is difficult to get off the streets and back into regular job to earn sufficient income for housing, especially where rents are high such as in most parts of Los Angeles.

Local governments and certain private charitable groups provide certain community shelters in large buildings for the homeless, but the number of spaces available falls far short of the needs of the homeless. In the County of Los Angeles it is estimated there are 84,000 homeless on the streets and only 22,000 beds available for them in such community shelters. Many are turned away even after traveling to a shelter and waiting in line, even in inclimate weather. Providing shelter for the homeless thorough such large buildings is also very costly on a per bed basis. Moreover, crowding the homeless into community shelters creates an unpleasant environment, as they lack privacy or separation from others, such that there are noise, health and security problems.

For a time in the 1980s a tent city for the homeless was allowed to exist for a time in the plaza of the civic center for the County of Orange in Santa Ana, approximately 35 miles south of downtown Los Angeles. Following public complaints the homeless were rounded up and removed from the area, although some in later years recovered large judgments from the city for being mistreated. In 1993 Dome Village opened near a freeway just west of downtown Los Angeles. The village includes twelve (12) architecturally distinct domes (costing up to $10,000 each), each of which house four (4) homeless individuals. While this is an improvement on a small scale over large community shelters, the inventor is informed four persons in each dome still leads to many problems.

From time-to-time natural disasters such as large fires, earthquakes, and the like occur in Los Angeles and elsewhere. Emergency shelter is needed and usually provided through opening up of large buildings such as school gymnasiums and the like, or tent cities. As an alternative, individualized modular shelter units as proposed by the inventor might be preferable and more economical emergency shelter when natural disasters occur.

SUMMARY OF THE INVENTION

An emergency shelter module includes a long rectangular box-like structure, having curved interior sidewalls, defining an area for a person in a lying down position. The interior sidewalls are curved for aesthetic and functional reasons, including for ease of cleaning the same. Further, the box-like structure has exterior sidewalls extending to an opposing end of the shelter unit defining a second separate area for storage of the person's belongings. Preferably the interior volume for the person resting or sleeping is generally cylindrically-shaped with a substantially flat bottom, and a bulkhead separating that volume from the other volume used for storage.

The box-like structure is preferably fabricated of molded plastic for light weight and low cost, and is watertight to keep out the rain and facilitate hosing out of the interior volumes of the modular shelter unit. Preferably there are raised bosses at corners and edges of the box-like structure, to avoid injuries on sharp corners and edges, and also to channel water away from dripping over the edges of the opposing ends of the module. Preferably the molded plastic includes fire resistant and sound dampening foam.

Preferably the shelter module includes locking doors (operable from inside or outside the module) closing off the sleeping and storage areas. Preferably the locking means are electronic for reasons which will be explained below. The shelter module preferably includes ventilation allowing outside air through the door and interior sidewalls.

The sleeping module is specially configured for securing together a number of similar structures, including additional shelter modules stacked one atop another. Preferably a number of legs protruding from a bottom of the box-like structure corresponding with cavities in a top of the box-like structure. Moreover, attachable similar structures include vertically-oriented modular utility units such as a toilet, a shower and a dressing room. Preferably, when the shower and dressing room are used they are secured together, and there is a passageway between the two, and a sink attached to the exterior of the dressing room.

Use of the emergency shelter is envisioned as follows. First, the specially configured sleeping modules (and other utility modules if desired) as described above are provided. Then the modules are tied together, preferably by engaging specially configured exterior wall structures. For the homeless reservations are taken electronically over the telephone or Internet. Information is provided to the homeless for a particular sleeping module and storage module to unlock the doors later that day. Preferably, the all the modules used are hosing out each day. For use after fires or earthquakes, local governments or private charities would arrange to transport the modules to an appropriate site.

OBJECTS OF THE INVENTION

It is an object of the present invention to provide low cost housing on a per user basis.

It is another object of the invention to provide housing individualized to separate and individual users and to maintain privacy.

It is another object of the invention to provide housing that is water-tight to protect users from the elements.

It is another object of the invention that the housing modules be easily cleaned and hosed out after each use.

It is another object of the invention that the housing modules be lightweight and portable for easy transportation to a preferred site.

It is another object of the invention that the housing modules be easily grouped together or stacked for storage.

It is another object of the invention that the housing modules be composed of fire resistant materials which will also dampen sound.

It is yet another object of the invention that the housing modules have smooth corners and edges to avoid injuring users.

It is yet another object of the invention that each housing module have a sleeping compartment separate from a storage compartment.

It is yet another object of the invention that the housing modules have locking compartments operable from the outside as well as inside the modules.

It is yet another object of the invention that the housing modules have adequate ventilation.

It is still another object of the invention to offer reservations by telephone or over the Internet.

These and other objects and advantages of the present invention will be apparent from a review of the following specification and accompanying drawings.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
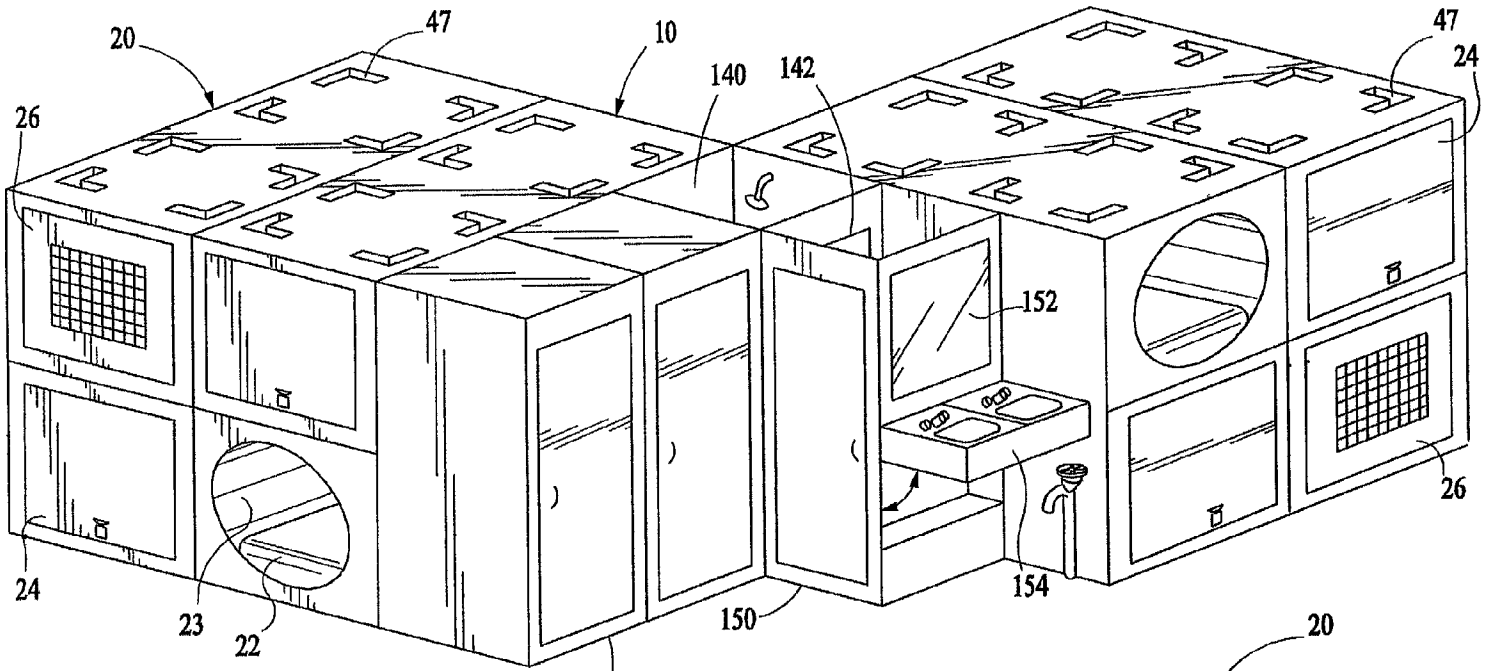
FIG. 1 is an overall perspective view of a grouping of modular structures of a preferred embodiment of the present invention.

Referring first to FIG. 1, shown is an overall perspective view of a small cluster of emergency shelter modules 10, including several modular shelter units 20 grouped together along with several modular utility units including toilets 130, a shower 140 and a dressing room 150. As desired, many additional modular shelter units or utility units could be added to the module cluster 10. For purposes of illustration only, the roof of the shower 140 and dressing room 150 are not shown. The outside wall of the dressing room 150 preferably includes a mirror 152 and deployable counter and sinks 154. Note there is preferably a passageway 142 between the shower 140 and dressing room 150.

Looking at the module cluster 10, the ends of eight (8) of the modular shelter units 10 can be seen. For illustration purposes, the doors 26 are not shown on two of the sleeping tubes 22. The modular shelter units 10 are normally arranged such that the sleeping tubes 22 and the storage lockers or lock boxes 24 alternate, so that a person using a particular sleeping tube 22 has an adjacent lock box 24, and so that entrances to the sleeping tubes 22 on each side of the module cluster 10 are less congested since half the entrances are on the opposite side. Advantageously, especially for the homeless, the lock boxes 24 are separate compartments from the sleeping tubes 22, so that the user's sleeping tube 22 is isolated from often contaminated belongings. The curved structure shown for the interior walls 23 of the sleeping tubes 22 was selected for several reasons, including ease of hosing the sleeping tubes 22 out after each use since there are no corners to be cleaned.

Figure 2:
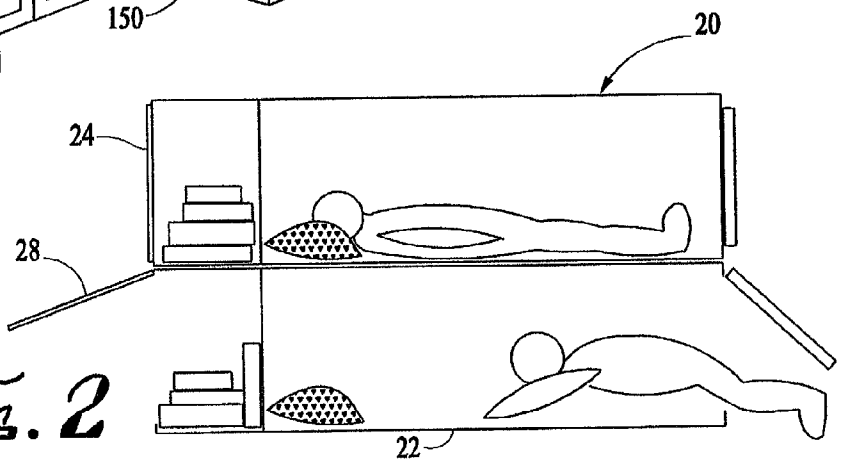
FIG. 2 is a side view of persons utilizing the modular shelter unit of the preferred embodiment.

Next referring to FIG. 2, shown is a side view of a pair of modular shelter units 20 stacked one atop the other. The upper unit shows the user resting comfortably with his or her personal belongings stored in the lock box 24. The height of the unit is preferably approximately 36 inches, and the diameter of the sleeping tube 22 is approximately 30 inches. This user should be able to access this upper sleeping tube 22 without the need for a ladder or step stool, or alternatively small ladders steps or toe holes could be built into the end face of the modular shelter unit to facilitate climbing into the sleeping tube 22. For the lower unit, a user is shown entering or exiting the sleeping tube 22, with the door 28 to his or her lock box 24 propped open. Optimally, one or more awnings (not shown) may be attached above the doors 26 of the modular shelter units 20.

Figure 3:
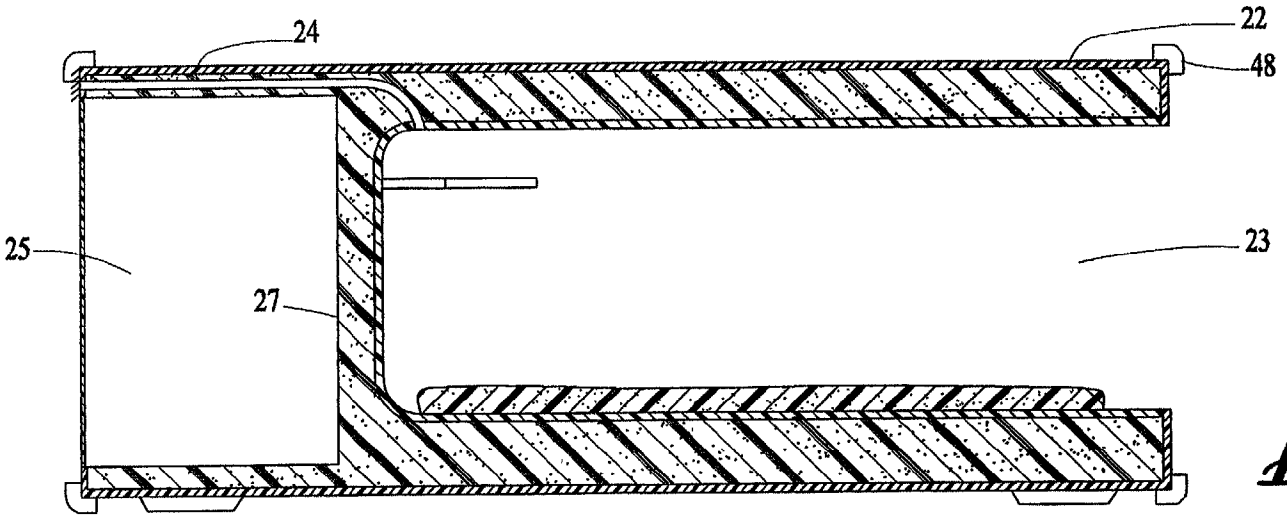
FIG. 3 is a section view through the modular shelter unit.
Figure 4:
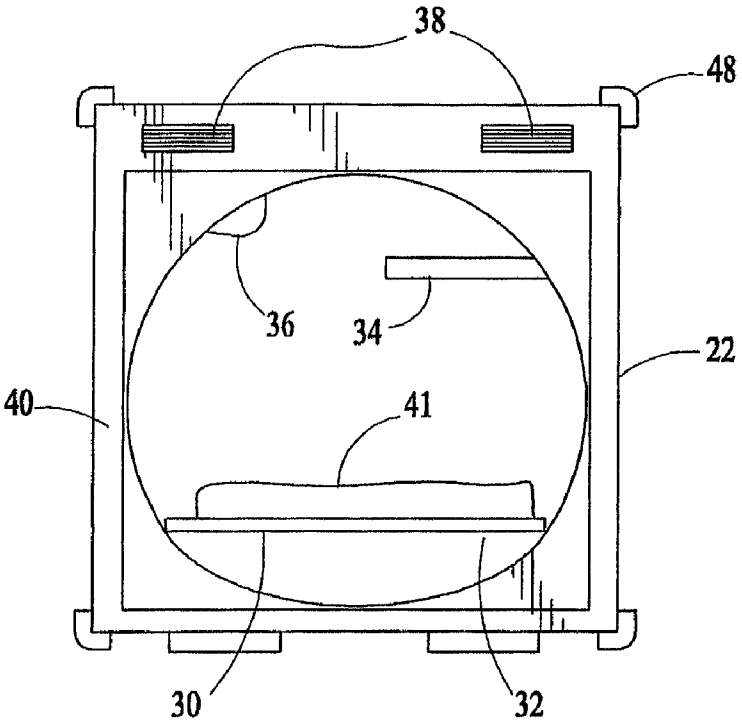
FIG. 4 is an end view of the modular shelter unit with a door removed.

Referring to FIG. 3, shown is a section view of the modular shelter unit 20, including the sleeping tube 22 defining an interior volume 23 for a reposed user, a lock box 24 defining a storage volume 25, and a bulkhead 27 therebetween. FIG. 4 shows an end view of the unit's sleeping compartment 22 with the door 26 removed for purposes of illustration. Preferably the bottom surface 30 of the sleeping tube is actually substantially flat, or alternatively a platform 32 can be brought in and engaged to the sleeping tube 22. Built into the far end of the sleeping tube are preferably a small shelf 34 and a battery-powered reading light 36. Other battery or solar powered devices may also optimally be included, e.g., an electric heater (not shown). Additionally, a pair of ventilation tubes 38 provide fresh air to the far end of the sleeping tube 22, and may optimally include air filters (not shown). The modular shelter unit 20 is preferably fabricated of blow molded plastic, filled with fire-resistant foam 40 which should also have a sound-dampening effect. The interior and exterior of the modular shelter unit 22 is watertight as well. It should be relatively inexpensive to manufacture is reasonably large quantities, and lightweight yet strong for ease of transportation and durability. A thin mattress 41 is preferably supplied.

Figure 5:
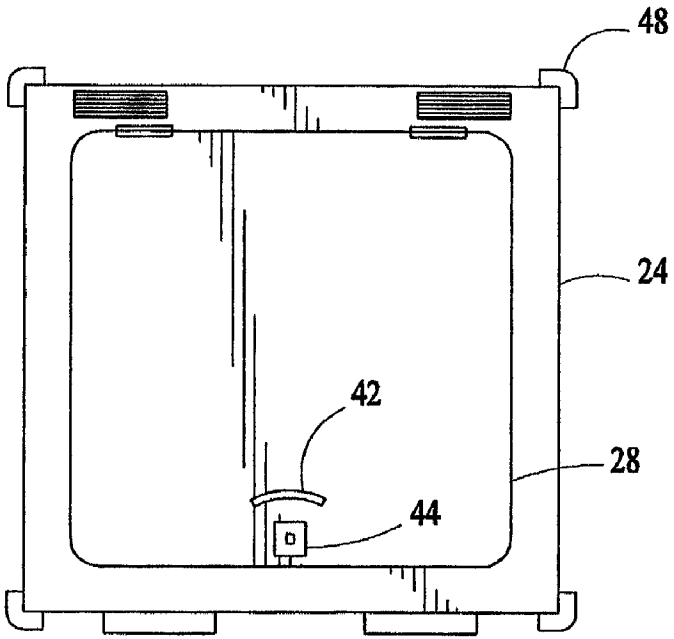
FIG. 5 is an end view of the modular shelter unit with a door in place; and, FIG. 6 is a bottom view of the modular shelter unit.

Now also referring to FIG. 5, shown is an end view of the storage locker or lock box 24 with the door 28 intact and closed. The door 28 includes a handle 42 to lift open the door 28, and an electronically operated lock 44. The lock 44 is operable from the outside upon entering the correct combination, and operable from the inside in that there is an emergency release to avoid entrapping a user. The sleeping tube 22 on its door 26 includes an identical or similar electronic lock 44 with an emergency release.

Figure 6:
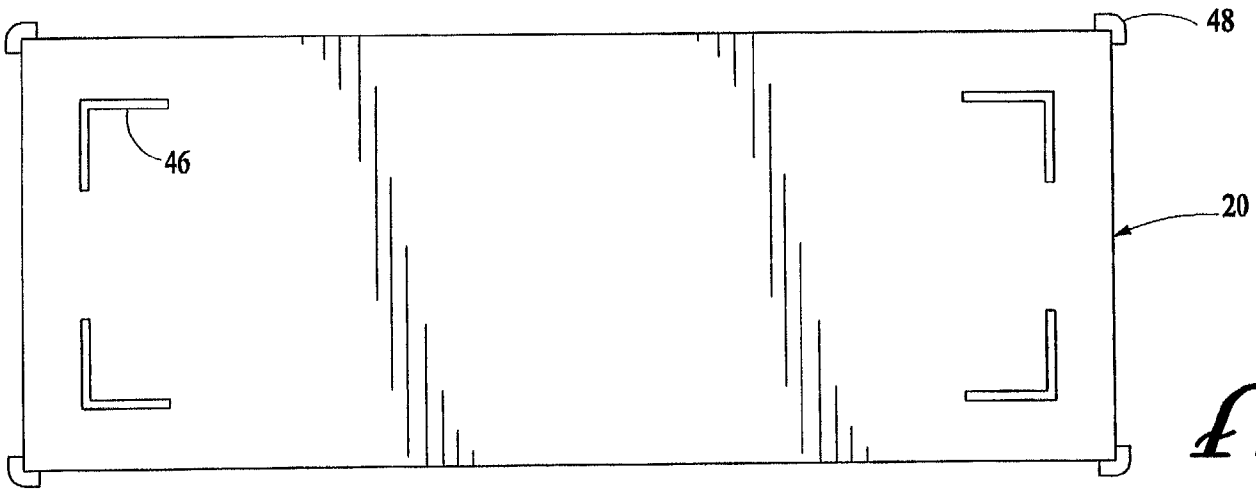

Finally, FIG. 6 shows a bottom view of the modular shelter unit 20, including four (4) short angle legs 46 which protrude from the bottom exterior sidewall surface 25. These legs 46 engage corresponding angle cavities 47 in the top surface of the modular shelter units 20, such that one unit may be securely stacked upon another, either aligned with one another or cross-crossed (not shown). Preferably modular sleeping units and other utility units are secured together using similar engaging structures in their exterior sidewalls 25. The grouping of the modules saves space, and tying them together as shown in FIG. 1 advantageously tends to prevent them from falling over. Additionally, a locking feature (not shown) may be built into the modules to prevent theft. As can be seen in FIGS. 3–6, the modular shelter units 20 preferably include raised corner and edge bosses 48 molded into the plastic, to eliminate sharp corners and edges and prevent injury. These raised bosses 48 should also facilitate carrying and handling of the units 20.

Having described the detailed structure of the modular emergency shelter system 10 of the preferred embodiment of the present invention, it is now possible to describe its use for the homeless or in the event of natural disasters such as earthquakes, large brush fires, floods or the like. First a relatively flat and safe site would be identified for placement of the modules 20, and possibly 130, 140, 150, configured as described above. Then they would be transported by truck or other means to the site, and preferably secured or tied together as described above. For the homeless, reservations could be taken to use the modular units over the telephone or Internet. Users would be given digital combinations to the electronic locks 44. Preferably those combinations would work only later that day, and the combinations would be changed the following day, possibly from a remote location.

While the present invention has been described with regards to particular embodiments, it is recognized that additional variations of the present invention may be devised without departing from the inventive concept.

What is claimed is:

1. A single modular shelter unit comprising a fully-assembled, horizontally oriented generally elongate rectangular box structure with a substantially flat bottom and having an interior defining a generally cylindrically shaped first volume with a flat bottom and sized only large enough for occupation by a single adult human in a reposed position, and a solid bulkhead and an exterior extending to an opposing portion defining a separate second volume for secure storage of the human's belongings, said elongate box structure having opposing far ends with openings and doors for the first and second volumes, at least the door for the first volume having an opening therein for air and light, and at least the door for the second volume having a lock, and the unit specially configured for tying together a plurality of similar modular structures without additional support structure.

2. The single modular shelter unit of claim 1 further comprising additional modular shelter units tied together and stacked one atop the other.

3. The single modular structure of claim 2 further comprising at least one vertically oriented units selected from the group consisting of a toilet, a shower and a dressing room and tied together with the modular shelter units.

4. The single modular shelter unit of claim 1 further comprising a plurality of legs protruding from the bottom of said box structure corresponding to a plurality of cavities in the top of said generally box structure, located and sized to accept said plurality of legs when the single modular shelter units are stacked one atop another.

5. The single modular structure of claim 1 wherein said box structure is fire resistant and sound dampening foam.

6. The single modular structure of claim 1 further comprising a light and shelf built into the first volume.

7. A single portable shelter unit comprising an elongate rectangular plastic water-tight structure having generally curved interior sidewalls and a flat bottom in combination with a bulkhead defining a first interior volume sized only large enough for a single adult to crawl in and rest in a reclined position, and said sidewalls extending to an opposing end portion in combination with the bulkhead defining a second interior volume not accessible from inside the first interior volume, the unit having opposing ends with openings in the first and second interior volumes and doors sized only large enough to provide access for the single adult, and the unit configured for tying together a plurality of similar portable units without additional support structure not part of the units.

* * * * *